United States Patent [19]

Cook et al.

[11] 4,444,524

[45] Apr. 24, 1984

[54] MOUNTING CLIP FOR TONGUE AND GROOVE PANELS

[75] Inventors: Melvin W. Cook, Dover; Rodney S. Campbell, Akron, both of Ohio

[73] Assignee: Masonite Corporation, Chicago, Ill.

[21] Appl. No.: 457,980

[22] Filed: Jan. 14, 1983

[51] Int. Cl.[3] ..... B25G 3/36; F16B 1/00

[52] U.S. Cl. ..... 403/387; 403/397; 52/489

[58] Field of Search ..... 403/387, 397; 52/489, 52/485, 483, 763, 772

[56] References Cited

U.S. PATENT DOCUMENTS

| | | | |
|---|---|---|---|
| 1,810,287 | 6/1931 | Mahon et al. | 52/489 X |
| 2,335,303 | 11/1943 | Olsen | 52/485 X |
| 2,831,222 | 4/1958 | Anderson | 52/489 |

FOREIGN PATENT DOCUMENTS

| | | | |
|---|---|---|---|
| 1125985 | 6/1982 | Canada | 52/485 |
| 601589 | 7/1978 | Switzerland | 52/489 |

*Primary Examiner*—Andrew V. Kundrat
*Attorney, Agent, or Firm*—Mason, Kolehmainen, Rathburn & Wyss

[57] ABSTRACT

A new and improved mounting clip for tongue and groove panels includes a body of thin flat sheet metal having a pair of deflectable wings on opposite sides adapted to be folded around opposite longitudinal edges of a flange on an elongated support member for the panel. The clip includes a panel support element between the wings having a tongue spaced from the body and adapted to engage a groove in the edge of the panel for securing the panel in place against the support member. Tongue and groove panels are installed transversely across elongated support members by mounting the clips on the supports and folding the wings over against the flange with the tongue of the clip engaged in the groove in the edge of the adjacent panels. The tongue of the succeeding panel is then inserted into the groove of the panel already in place and another clip installed to support the succeeding panel, etc.

10 Claims, 4 Drawing Figures

FIG. 1
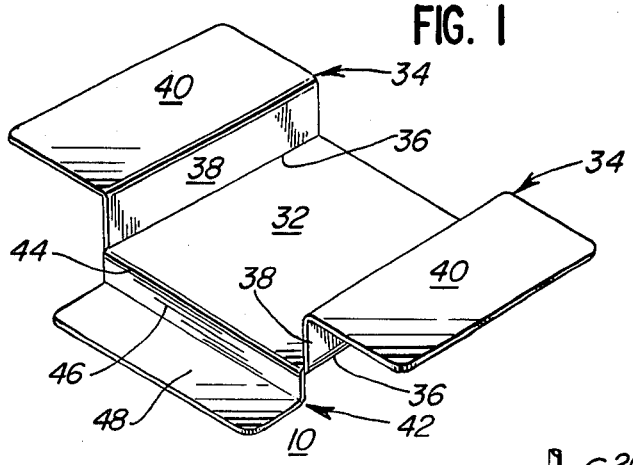
FIG. 2
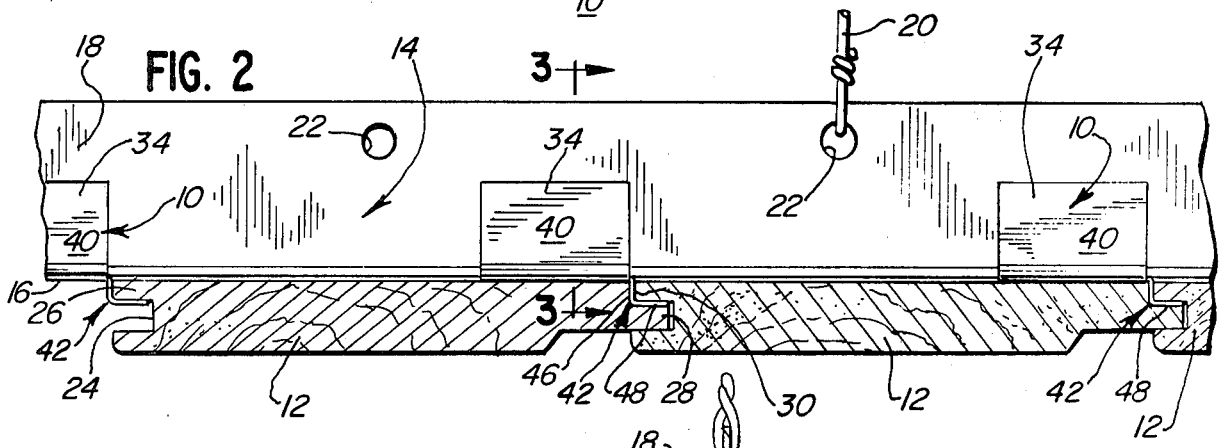
FIG. 3
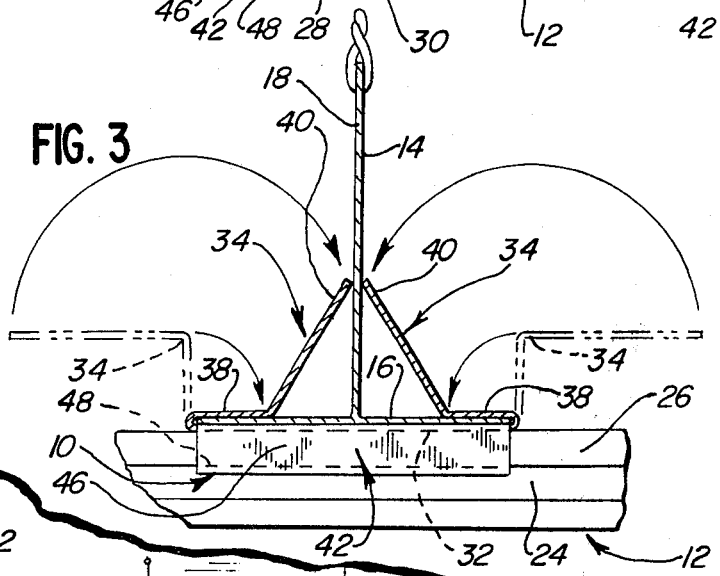
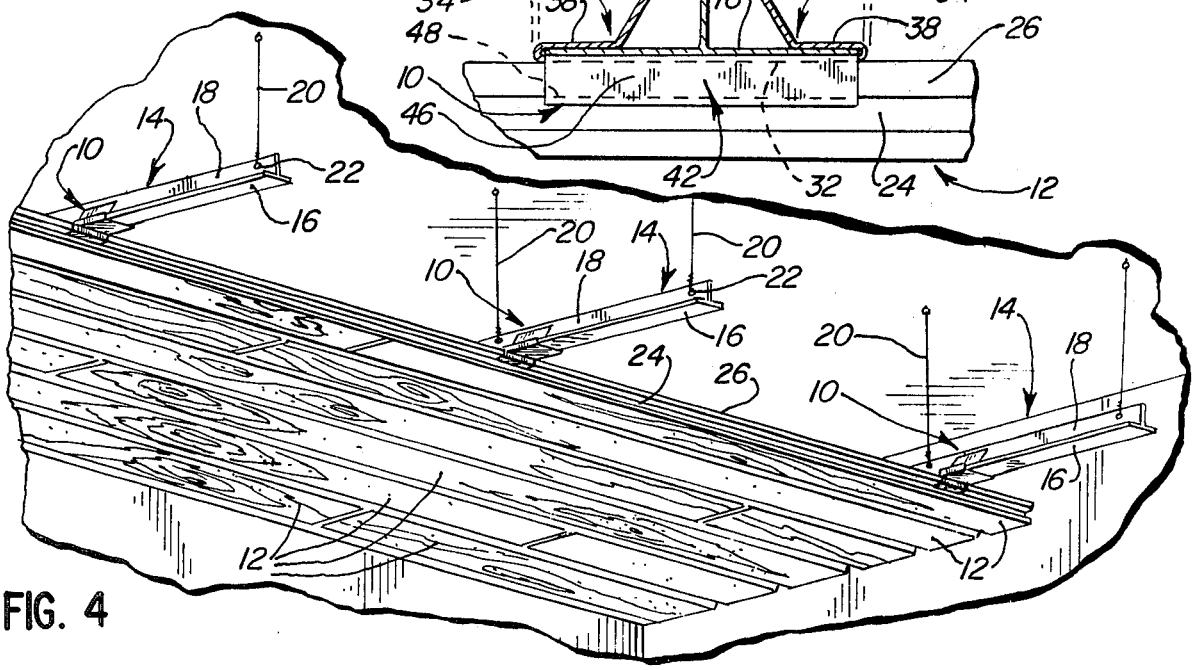
FIG. 4

MOUNTING CLIP FOR TONGUE AND GROOVE PANELS

BACKGROUND OF THE INVENTION

The present invention relates to a new and improved mounting clip for tongue and groove panels and a method of installing tongue and groove panels across elongated support members with the novel clip in accordance with the present invention.

It is an object of the invention to provide a new and improved mounting clip for tongue and groove panels for securing the same across elongated support members such as T-bars commonly used in suspended ceilings, walls and the like.

Another object of the invention is to provide a mounting clip which requires no fasteners or other crimping tools for mounting the clips in place for holding the panels securely against a T-bar support.

Another object of the invention is to provide a new and improved method of installing tongue and groove panels transversely across elongated support members such as T-bars using small metal clips in accordance with the present invention.

Still another object of the present invention is to provide a new and improved method of the character described which permits rapid installation of tongue and groove panels for a ceiling or wall structure without requiring the use of tools such as crimping pliers, punches, rivet guns, staple applicators or the like.

SUMMARY OF THE INVENTION

The foregoing and other objects and advantages of the present invention are accomplished in a new and improved mounting clip for supporting tongue and groove panels from the flange of elongated support members such as T-bars and the like. The mounting clip includes a body formed of thin, flat sheet material having a pair of deflectable wings along opposite sides which are adapted to be folded around opposite longitudinal edge of a panel for holding the panel in position extended transversely across the support members.

A novel method of installing tongue and groove panels includes mounting a clip on the flange of a T-bar and securing the same in place by folding a pair of deflectable side wings around the opposite longitudinal edges of the T-bar and engaging a tongue of the clip against a surface in the groove in the edge of a tongue and groove panel to secure the panel in place.

BRIEF DESCRIPTION OF THE DRAWINGS

For a better understanding of the present invention, reference should be had to the following detailed description taken in conjunction with the drawings, in which:

FIG. 1 is a perspective view of a new and improved panel mounting clip constructed in accordance with the features of the present invention;

FIG. 2 is an enlarged, cross-sectional view, of a ceiling or wall structure utilizing tongue and groove panels installed and secured to a T-bar grid member with mounting clips in accordance with the present invention;

FIG. 3 is a transverse cross-sectional view taken substantially along lines 3—3 of FIG. 2; and FIG. 4 is a perspective view looking upwardly at a ceiling structure having a plurality of elongated tongue and groove panels secured transversely across a grid of supporting T-bar elements with mounting clips in accordance with the features of the present invention.

DESCRIPTION OF THE PREFERRED EMBODIMENT

Referring now more particularly to the drawings, in FIG. 1 is illustrated a new and improved mounting clip 10 constructed in accordance with the features of the present invention. The clip 10 is especially designed and adapted for securing tongue and groove wall or ceiling panels 12 positioned to extend transversely against and across a grid formed by parallel elongated support members 14 in a ceiling or wall structure. The supports 14 include a lower or outer transverse flange 16 and a web 18 normal thereto providing a T-shape transverse cross-section and supports of this type are known as a T-bar (best shown in FIGS. 3 and 4). When the tongue and groove panels 12 are installed for a ceiling or wall of a room or building, the elongated T-bars 14 are normally suspended in a parallel grid like structure as shown in FIG. 4 by means of wires or rods 20 attached to the web 18 of the T-bar and the wires are passed through holes 22 provided at suitable intervals.

The T-bars 14 are often spaced two foot apart on center but greater or smaller spacing intervals may be used as desired. The T-bar grid is installed with care to provide a true, level and planar ceiling or vertical side wall structure when the panels 12 are secured thereto extending transversely to the longitudinal axes of the T-bars as shown.

The panels 12 are provided with edge grooves 24 along one longitudinal edge face 26 and these grooves are dimensioned to receive a tongue 28 of an adjacent panel formed along an opposite longitudinal edge 30 so as to provide a tongue and groove joint between each pair the panels as best illustrated in FIGS. 2 and 4. The panels 12 may comprise a wide variety of synthetic or man-made artificial materials or may comprise solid wood members machined along opposite edges to provide a tongue and groove as shown. Similar tongue and groove joints may be provided at opposite ends of the panels as illustrated generally in FIG. 4.

In accordance with the present invention, the novel mounting clips 10 are made of relatively thin sheet metal such as 26 gauge, zinc coated, non-bonderized electrolytic steel (0.0172" in thickness) and the clips include a generally rectangular body or base 32 and a pair of integral, deflectable, gull-shaped wings 34 on opposite sides 36 of the body. Each wing includes a first or inner leg 38 normal to the body plane and an integral outwardly extending second leg 40 parallel to the body plane having rounded outer corners along the free edge. As best illustrated in FIGS. 1 and 2, the inner legs 38 on opposite sides of the body are spaced apart by a distance that is slightly greater than the transverse distance or dimension between opposite longitudinal edges of the flange 16 of the T-bars 14 so as to accommodate the full width of the T-bar between the legs when the clip is positioned with the inside face of the body 32 against the outer or lower face of the T-bar flange, as best shown in FIG. 3.

The sheet metal clip also includes a panel support element 42 between the wings 34 integrally formed along a transverse edge 44 normal to the sides 36 of the body 32. The panel support element includes an integral first or stop leg 46 normal to the body plane and the leg stop extends in a direction opposite to that of the first legs 38 of the wings 34. A panel support tongue 48 is integral with the first leg 46 and extends outwardly normal and parallel with the body 32 of the clip. The tongue 48 is adapted to engage and support an upper surface in a groove 24 of a panel member 12 when in place as shown.

In accordance with the present invention, the mounting clips 10 are secured in place on the elongated T-bars 14 by folding the wings 34 around opposite longitudinal edges of the T-bar flange 16 as illustrated in FIG. 3. The wings 34 are pivoted from the initial position shown in dotted lines to a support or locking position illustrated in solid lines wherein the first legs 38 are generally parallel to the body 32 and overlap the upper side faces of the T-bar flange 16. The outer or second legs 40 of the wings are deflected so that the free outer edges tend to engage and bite against opposite sides of the web 18 of the T-bar.

The tongue 48 of the clip is extended into the groove 24 in the leading edge 26 of the adjacent panel 12 and the panel is positioned against the flange 16 and transversely of the T-bar 14 so that the upper surface of the tongue engages and supports an upper surface of the groove thereby holding the panel securely in place. The sheet metal that forms the tongue 48 is relatively thin so that the insertion of the tongue in the panel groove 24 does not substantially interfere with subsequent insertion of an adjacent panel tongue 28 of a next succeeding panel member during the installation process as best illustrated in FIG. 2. During installation, the stop legs 46 of the clips provide stopping engagement against the edge surface 26 of the panels 12 to secure the cross position of the panels on the supporting T-bars 14.

No fasteners, crimping elements or tools are required to secure the clips in place on the T-bars for holding the panels when installing a ceiling or wall structure as shown. By manual pressure on the foldable or deflectable wings 34, ample holding force is generated to establish and maintain permanent deflection of the wings for locking the clips in place on the T-bars as shown. Bending of the wings is normally accomplished after the supporting tongue 48 of the clip is inserted into a groove 24 of a leading panel 12 with the stop leg 46 against the edge face 26 as illustrated in FIG. 2.

From the foregoing it will be seen that a ceiling or wall formed of tongue and groove panels 12 and T-bars 14 may be rapidly installed and assembled using the novel clips 10 and without the need further tools or additional fasteners. The resulting wall or ceiling is neat and clean in appearance and requires only minimal installation costs. The clip system as described and shown is particularly well suited for use by unskilled labor and "do-it-yourselfers".

Although the present invention has been described with reference to a single illustrated embodiments thereof, it should be understood that numerous other modifications and embodiments can be made by those skilled in the art that will fall within the spirit and scope of the principles of this invention.

What is claimed as new and is desired to be secured by Letters Patent is:

1. A mounting clip for supporting a tongue and groove panel from a flange of an elongated support member, comprising:

a body formed of thin, flat sheet metal having a pair of deflectable wings along opposite sides adapted to be folded around opposite longitudinal edges of said flange for securing said body on said flange, at least one of said wings including a first leg normal to said body and joined thereto by a folding edge and a second leg integrally joined therewith extending outwardly of said body adapted to facilitate manual deflection of said wing for folding said first leg into a position overlying said flange, with said folding edge, first leg, and flange proportioned to allow said first leg to be folded into a position generally parallel to said body, and a panel support element between said wings including a tongue member spaced from said body adapted to engage a tongue or groove of a panel for holding said panel in position against said support member extending transversely thereof.

2. The mounting clip of claim 1 wherein said panel support element extends transversely to said wings along an end of said body.

3. The mounting clip of claim 1 wherein said panel support element includes a stop leg normal to said body adapted to bear against an edge face of said panel adjacent said tongue or groove therein.

4. The mounting clip of claim 1 wherein both of said wings include a first leg normal to said body and a second leg joined to the first extending outwardly of said body, said first legs spaced apart to accommodate said flange therebetween when said body of said clip is positioned against said flange.

5. The mounting clip of claim 4 wherein said second leg of said wings includes a free outer edge adapted for engaging at an acute, angle a web of said elongated support member which is normal to said flange.

6. The mounting clip of claim 3 wherein said tongue member extends parallel of said body and outwardly of said stop leg for engaging a surface in said groove of said panel parallel of the faces thereof.

7. A method of installing tongue and groove panels transversely of an elongated support member having a flange with opposite longitudinal edges, comprising the steps of:

positioning a pre-formed clip made of thin sheet metal with a body thereof against the flange of said elongated support member and with opposite longitudinal edges of said flange positioned between first legs of a pair of integral side wings of said clip, which wings are preformed normal to said body;

securing said clip in place on said elongated support member by manually deflecting outer second legs of said side wings toward one another to fold said first legs of side wings around opposite edges of said flange to overly said flange and generally parallel to said body; and engaging a tongue member of a panel support element on said clip against a surface in a tongue or groove of a panel transversely placed against said elongated support member for holding said panel in place.

8. The method of claim 7 including the step of:

positioning a stop leg of said panel support element on said clip against an edge of said panel adjacent said tongue or groove therein when folding said first legs of said side wings around said opposite longitudinal edges of said flange.

9. The method of claim 7 including claim 7 including the step of:

positioning a second panel in tongue and groove interlocking relationship with said first mentioned panel by inserting a tongue or groove of said second panel into said groove or tongue of said first mentioned panel in engagement against said tongue member of said clip.

10. The method of claim 9 including the step of:

installing a second of said clips on said elongated support member with the tongue member of said second clip engaged in the tongue or groove of said second panel for securing the second panel on said elongated support member in tongue and groove interlocking relation with said first mentioned panel transversely of said elongated support member.

* * * * *